United States Patent [19]

Watts

[11] 4,012,552

[45] Mar. 15, 1977

[54] DECORATIVE METAL FILM HEAT TRANSFER DECALCOMANIA

[75] Inventor: Tom J. Watts, Sherborn, Mass.

[73] Assignee: Dennison Manufacturing Company, Framingham, Mass.

[22] Filed: Mar. 10, 1975

[21] Appl. No.: 556,871

[52] U.S. Cl. ..... 428/200; 428/202; 428/204; 248/914; 427/147; 427/148; 156/233; 156/234

[51] Int. Cl.[2] ..... B44C 1/16; B41M 3/12

[58] Field of Search ..... 428/914, 195, 200, 202, 428/204, 209; 427/147, 148, 149; 156/233, 234

[56] References Cited

UNITED STATES PATENTS

| | | | |
|---|---|---|---|
| 3,080,270 | 3/1963 | Lorenz | 156/233 |
| 3,519,512 | 7/1970 | Downs | 428/195 X |

*Primary Examiner*—Ralph S. Kendall
*Attorney, Agent, or Firm*—Kenneth D. Hudson

[57] ABSTRACT

A receiving surface is decorated with a metal film in a pattern by applying an area of thin frangible metal to a temporary carrier having a release surface, printing an adhesive in the pattern desired for the metal on either the metal film or receiving surface, the area of the pattern being less than the area of the metal film, pressing and adhering the receiving surface and metal film together with the adhesive therebetween, and stripping away the carrier. The metal over the adhesive remains on the receiving surface to provide the decorative metal pattern and the balance is carried away with the carrier. The receiving surface can be a final surface to be decorated or can be the exposed surface of an ink design heat transfer. In the latter case, a combined heat transfer having both a decorative metal film pattern and a multicolor ink design can be provided by coating the receiving surface, after transfer of the metal film pattern thereto, with a second adhesive over both the metal pattern and ink design.

5 Claims, 4 Drawing Figures

DECORATIVE METAL FILM HEAT TRANSFER DECALCOMANIA

BACKGROUND OF THE INVENTION

This application relates to decorative heat transfers or decalcomania, and more particularly to heat transfers far providing a decorative metal film pattern.

Metal foil decorations have been applied by hot stamping techniques to plastics, paper and other relatively soft embossable surfaces, have good brilliance, and are in substantial use. However, hot stamping has not been generally applicable to hard or rigid surfaces such as glass, metal, ceramics, some thermoset plastics, and the like. Hot stamping also requires a stamping die and a relatively long dwell time for transfer which limits the production rates obtainable. Also, hot stamping foils have not normally included descriptive or decorative ink designs printed to be exposed after transfer.

Discrete, pre-printed heat transfers comprising ink designs, often in multiple colors printed sequentially in register, are known and are also in substantial use. Examples of such discrete, pre-printed transfers are shown for example, in U.S. Pat. Nos. 2,862,832; 2,989,413 and 2,990,331. Equipment for applying such decorations to a receiving surface is disclosed in U.S. Pat. Nos. 3,064,714 and 3,231,948. Such transfers can be pre-heated to or near transfer temperature and much shorter dwell times are required, as little as 25 milliseconds being sufficient, permitting relatively high production rates. Decorative ink designs are inherent. Such discrete transfers can also be applied to rigid surfaces such as glass, ceramics, metal and the like.

Discrete, pre-printed heat transfers have not incorporated metal foil patterns because it has not been feasible to vacuum deposit metal in a pattern and the moisture in the commonly employed paper carriers causes difficulties in deposition. Therefore metal has been avoided or its effect simulated with pigmented inks which lack the attractiveness and appearance of foil.

It has been proposed in U.S. Pat. No. 3,463,651 to print an ink design on the release surface of a plastic film, then to vacuum metalize the entire release surface, followed by overcoating with an adhesive. However by this procedure it is not possible to provide metal in a pattern on the decal, paper cannot be used as a backing, and a transfer die is required. Also the carrier web must be removed from the press for metallizing and thereafter remounted for coating the adhesive.

SUMMARY OF THE INVENTION

Objects of the present invention are to provide novel heat transfer decalcomania, including discrete, pre-printed transfers, which incorporate metal foil, together with methods of making them. Further objects include provision of metal foil heat transfers which can be rapidly and economically made and applied on existing equipment, and which do not require use of a heat stamping die.

In one embodiment of the present invention, a hot stamp metal foil is provided but preferably without the final adhesive layer. Such foils comprise a temporary carrier, typically a smooth plastic film of regenerated cellulose or polyester, coated on one surface with a release layer, and over the surface of the release layer, a thin layer of frangible metal. The metal can be of any suitable type applied by foil lamination or vapor deposition by vacuum metalizing, electron gun or cathode deposition, but is most commonly vacuum deposited aluminium.

The final adhesive layer normally applied in hot stamping is preferably omitted. Instead, an adhesive is printed over the metal surface in the desired, predetermined pattern. The adhesive may be of any suitable known type such as an adhesive pressure-sensitive at room temperature, adhesives non-tacky at room temperature but heat-activatable at elevated temperature, or curable adhesives. The desired metallic decoration is applied to a receiving surface by pressing and adhering the adhesive thereto, and pulling the backing or temporary carrier away, leaving a replica in metal of the predetermined pattern. No special hot stamping die is required and existing transfer equipment can be used. Where the geometry of the receiving surface is suitable, as in a flat surface such as described below, the adhesive can be printed thereto rather than to the metal foil. If desired, the adhesive pattern can be printed on both the receiving surface and the metal film, one in reverse, and the two adhesives superposed during lamination, although this is not normally required or desirable. Where a meltable release layer is employed, the printed adhesive is preferably a heat-activatable adhesive activated at transfer temperature, typically from about 200° F. to 450° F., and more typically from 250° F. to 350° F., at which the release layer is melted.

In a second or further embodiment, a heat transfer having in combination both a pattern or design of printed ink in one or more colors and a pattern of bright metal film is provided which can be made by a simple and inexpensive process including a two-stage transfer in which the first stage employs the metal transfer of the first embodiment described above. The two designs or patterns can be arranged so that they are wholly or partly superimposed in the heat transfer so that after application to the desired receiving surface to be decorated and removal of the backing or carrier, the printed ink pattern is superimposed upon and obscures in part the metal film, or they may be arranged so that each pattern is laterally displaced with respect to the other, so that each is visible in its entirety after use of the transfer. In this embodiment, the backing or temporary carrier for the transfer can readily be paper without causing difficulties in vacuum metallizing and without impairment of the glossy, reflective effect of the metal film.

In this further embodiment, a discrete, pre-printed heat transfer decoration or decalcomania for decorating a receiving surface with both an ink design and a metal in a predetermined pattern comprises a temporary carrier having a smooth release surface, a printed ink design, a first adhesive printed in the predetermined pattern, a film of metal bonded to and commensurate in area to said first adhesive, and a second adhesive layer overlying the ink design and metal pattern. By discrete, pre-printed transfer is meant that the design materials, the ink design and metal pattern, exist on the carrier in the pattern and contour desired to be transferred. This is in distinction to hot stamp foil transfers wherein the layers are continuous and the pattern and contour of individual decorations are died out under heat and pressure with a specially configured hot stamping die. The final adhesive of this embodiment is preferably also printed in the discrete area to be transferred, whereby all layers to be transferred are discrete and no special die is required. However, if desired, continuous adhesive films of the type used in hot stamp foils can be used and areas thereof transferred with a hot die.

The heat transfer decorations or decalcomania of the second embodiment are provided in the preferred procedure by printing an ink design and an adhesive in a predetermined pattern on a first temporary carrier having a smooth release surface, providing a second temporary carrier having a smooth release surface and a frangible film of metal thereover, bringing the surface of said metal into contact with said adhesive pattern and adhering the metal film to said adhesive, pulling said second carrier away from the adhesive pattern to rupture said metal film along the margin of said adhesive pattern, leaving a metal film pattern commensurate in area with said adhesive pattern, and thereafter applying a second adhesive over said ink design and metal pattern. All of the steps of this method can be readily performed in a multiple station printing press. The first temporary carrier having a release surface is preferably an elongate web of paper fed through a rotogravure press or the like, the ink design printed thereon in multiple colors, the first adhesive printed, a metal foil transferred thereto by lamination, and the second adhesive printed over the ink and metal in one continuous, high speed operation. The metal release foil can be obtained from available hot stamping sources, pre-heated to activate the release, and registration of all layers controlled by the press.

DESCRIPTION OF PREFERRED EMBODIMENTS

Figure 1:
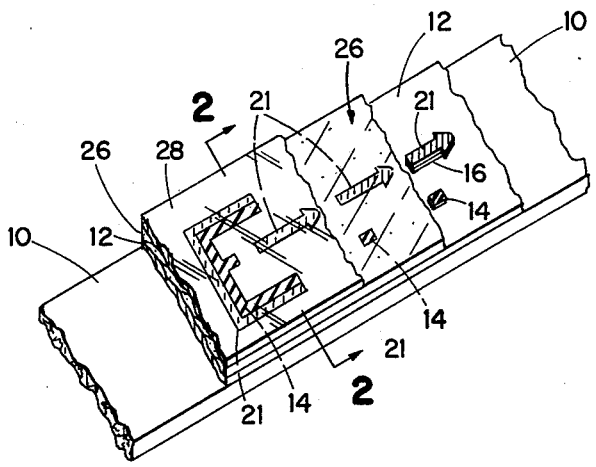
FIG. 1 is an isometric view partly broken away of the second embodiment of the present invention.
Figure 2:
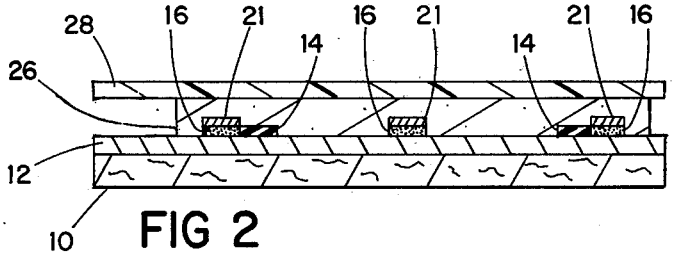
FIG. 2 is a view in section taken along line 2—2 of FIG. 1.
Figure 4:
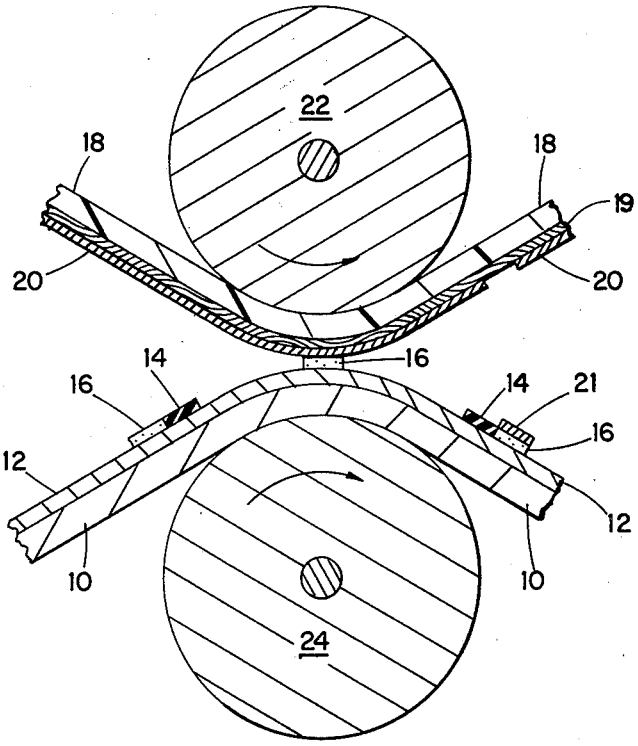
FIG. 4 is a schematic view showing one step in the process of making a heat transfer according to the second embodiment.

As shown in the drawings, the backing 10 for the heat transfer of FIGS. 1, 2 and 4 can be of a plastic such as regenerated cellulose or a polyester, but preferably is of paper which has a relatively lower cost. Some papers are sufficiently smooth so that no sizing or other special treatment is required to prepare them for use as a backing or carrier, while others can be made satisfactory by means of conventional sizings. A release coating or transfer layer 12, which may be a conventional wax coating, coated or printed, but which is preferably a dry release, is laid down upon the face of the paper 10 and the exposed surface of the release coating is printed with a pattern 14 of conventional ink, e.g., lacquers of polyamide or nitrocellulose resins containing pigments or dyes, using conventional printing equipment such as letter press, rotogravure, or flexographic presses. Multi-color patterns can be printed in the usual manner. Following the printing of the ink pattern or design 14, a predetermined pattern 16 is printed using a conventional transparent adhesive composition instead of ink. The adhesive composition may be one of the usual pressure-sensitive adhesives which are tacky at room temperature or it may, if desired, be a heat-activatable or heat-sensitive adhesive which is tacky only when heated to elevated temperatures. The adhesive pattern employed is precisely the pattern desired for the metal film in the finished heat transfer.

Following the printing operations, there is provided a conventional hot stamping film consisting of the polyester backing or temporary carrier 18 (FIG. 4) carrying a release coating of meltable wax or resin 19 on which a thin evaporated aluminium film 20 is deposited. The metal film 20 can have a conventional overall heat-activatable adhesive layer, where lamination is performed below activation temperature, but preferably such overall adhesive layer is omitted. Except for the final adhesive layer, this hot stamping film is of the type commonly used for applying metal film to plastic or the like by means of a heated die.

The hot stamping film is pressed against the adhesive pattern 16 as shown in FIG. 4, by passing the hot stamping film and the partly completed heat transfer carrying the exposed adhesive pattern 16, between a pair of rolls 22, 24 to place the metal film 20 in contact with the adhesive pattern 16 and to bond or adhere the film to the pattern. If the adhesive pattern 16 is a pressure-sensitive adhesive, the partly completed heat transfer need not be heated, although the metal hot stamping film should be preheated if necessary to activate the meltable release therein. If the adhesive pattern 16 is a heat activated adhesive, the necessary heat is supplied by preheating the partly completed transfer and the hot stamping film and/or by heating one or both of rolls 22, 24 to bond the two films together.

Backing 18 is then pulled free, as shown in FIG. 4, the extremely thin metal film rupturing at the margin of the adhesive pattern 16 and leaving a portion 21 of metal film bonded to the adhesive pattern co-extensive or commensurate in area with the pattern, the remainder of the metal film which did not come into contact with the adhesive pattern 16 remaining with backing 18 and being carried off with it. Release layer 12 should retain contacting layers during stripping, e.g., by preheating only layers 18–20, by use of a dry release having a greater adhesion than layer 19, or by using a meltable release material 12 having a higher activation temperature than layer 19.

The heat transfer is then completed by applying a layer 26 of adhesive, preferably transparent and colorless, as a discrete area entirely overlying the heat transfer including both the ink design and metal pattern. This adhesive layer can be pressure-sensitive adhesive, in which case a peelable temporary protective layer 28, or release sheet, is also applied to protect the adhesive layer until the heat transfer is used. Preferably, however, a heat-activatable adhesive, such as a well-known polyamide lacquer, is used for layer 26 so that it is non-tacky at room temperature which does not require the use of a protective layer or release sheet 28.

The completed heat transfer is used in a conventional manner by removing the protective layer or sheet 28, if present, then pressing the adhesive surface 26 against the surface to be decorated, using sufficient heat, if necessary, to activate release coating 12 and/or adhesive 26 and leave the ink pattern 14 and metal film 21 bonded to the receiving surface. The metal film pattern 21 is visible through any residual release coating 12 where a meltable material is employed, providing a shiny, glossy metallic appearance substantially similar to that provided by conventional hot stamping procedures. No heated die is required for using the heat transfer above described, the transfer being applied in the usual manner using conventional existing equipment by means of a smooth surfaced roll or platen.

Figure 3:
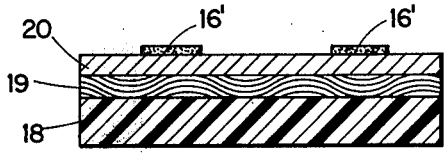
FIG. 3 is a section of the first embodiment similar to FIG. 2.

In the embodiment shown in FIG. 3, a modified hot stamping foil is shown in which the adhesive pattern 16' is printed over the surface of the metal film rather than over the carrier 10. This modified foil can be employed as shown in FIG. 4 for lamination to a partly completed heat transfer 10, 12 and 14, although it is preferable to print an adhesive 16 in a pattern over carrier 10. The embodiment shown in FIG. 3 can also be employed as a heat transfer to decorate a receiving surface with a pattern of metal where only the decoration of the metal pattern is desired. In such use, the transfer of FIG. 3 is pressed against the receiving surface to be decorated and sufficient temperature applied either by preheating the transfer, or by heating the pressure-applying device, or both, to activate the adhesive 16', if necessary, and to melt the release layer 19 if a meltable release material is employed. Again, no hot stamping die is required, and the transfer may be applied at relatively high speed with conventional decorating equipment employing a smooth roller or platten. Again, hard surfaces, such as glass, ceramic, or metal or the like can be decorated.

The release layer 19 can comprise any suitable material but is usually a wax or resin meltable between about 200° F to about 450° F. Likewise release layer 12 can comprise any suitable material, printed or coated, including waxes and resins melting in the same temperature range as disclosed in the three earlier cited patents. However, it is preferably a resinuous dry release, more preferably a cured thermosetting resin, which has a low adhesion for the design sufficient to allow printing and dry stripping. Such preferred dry releases do not melt and are not affected by any heat employed in applying metal film 21. The inks in design 14 do not normally cause any problem from reasonable amounts of heat because the pigments, dyes and other fillers therein substantially reduce the tack of such materials when heated. Thus in the most preferred example of the second embodiment, carrier 10 is paper, release layer 12 is a dry release material providing releaseable adhesion greater than activated layer 19, adhesive 16 is heat-activatable at room temperature, carrier 18 is a polyester film, release layer 19 is a meltable wax and adhesive 26 is an adhesive heat-activatable in the range of about 200° F. to about 450° F. but non-tacky at room temperature.

As shown in FIG. 1, the printed image is right reading as appropriate for decorating the under side of a transparent film or plate. For front surface decoration, the image is printed in reverse so as to be right reading after transfer.

While the layers shown are the preferred structure, it is well known in both discrete pre-printed decals and hot stamping foils that other layers may be employed. Thus, tint and/or protective lacquers are interposed between the release 19 and metal 20 or between the release 12 and ink design 14. Prime coats are also sometimes used between metal 20 and adhesive 16. Such additional known layers can also be used in the transfers of this invention where desired.

In addition, materials other than bright metal film can be provided in a pattern, if desired. For example, wood grains, fluorescent coatings, and opaque coating can similarly be provided. The effect of additional printing stations and greater thickness can be obtained.

It should be understood that the foregoing description is for the purpose of illustration and that the invention includes modifications and equivalents within the scope of the appended claims.

I claim:

1. A preprinted heat transfer decalcomania for decorating a receiving surface with both an ink design and a metal in a predetermined pattern, which comprises a temporary carrier having a smooth release surface, a printed ink design, a first dry, transparent adhesive printed in said predetermined pattern, a film of metal bonded to and commensurate in area to said first adhesive, and a second adhesive layer overlaying said ink design and metal pattern adapted upon application of heat and pressure to adhere the decalcomania to said receiving surface.

2. A heat transfer according to claim 1 wherein said temporary carrier is paper and said metal film is formed by vapor deposition.

3. A heat transfer according to claim 2 wherein said first adhesive is pressure-sensitive at room temperature.

4. A heat transfer according to claim 2 wherein said first adhesive is a heat-activatable adhesive non-tacky at room temperature and wherein said release surface is a dry release surface.

5. A heat transfer according to claim 1 wherein said release surface is a release layer printed in an outline commensurate in area with the printed ink design and metal pattern.

* * * * *